US005369474A

United States Patent [19]

Yamada

[11] Patent Number: 5,369,474

[45] Date of Patent: Nov. 29, 1994

[54] IMAGE FORMING APPARATUS INCLUDING A DEVELOPER DEVICE ENGAGING AND DISENGAGING MECHANISM

[75] Inventor: Akira Yamada, Kawasaki, Japan

[73] Assignee: Fujitsu Limited, Kawasaki, Japan

[21] Appl. No.: 798,172

[22] Filed: Nov. 26, 1991

[30] Foreign Application Priority Data

Nov. 30, 1990 [JP] Japan ..... 2-340121

[51] Int. Cl.[5] ..... G03G 15/06

[52] U.S. Cl. ..... 355/245; 355/210

[58] Field of Search ..... 355/245, 246, 259, 200, 355/210, 211; 118/656, 657, 658

[56] References Cited

U.S. PATENT DOCUMENTS

| | | | |
|---|---|---|---|
| 4,928,146 | 5/1990 | Yamada | 355/253 |
| 4,931,834 | 6/1990 | Suga | 355/200 |
| 4,975,746 | 12/1990 | Miyauchi et al. | 355/245 |
| 4,989,037 | 1/1991 | Nagatsuna | 355/200 |
| 5,061,968 | 10/1991 | Kita | 355/326 |
| 5,068,691 | 11/1991 | Nishio et al. | 355/259 |
| 5,126,800 | 6/1992 | Shishido et al. | 355/211 |
| 5,142,322 | 8/1992 | Surti | 355/200 |

*Primary Examiner*—Leo P. Picard
*Assistant Examiner*—Christopher Horgan
*Attorney, Agent, or Firm*—Staas & Halsey

[57] ABSTRACT

A developer device engaging and disengaging mechanism for an image forming apparatus which includes an image forming device and a developer device which develops an image formed by the image forming device. The developer device includes a first gear for driving the developer device and the image forming apparatus includes a second gear, coupled to a frame thereof, for transmitting power from a power source to the first gear. The developer device is placed in a first position where the developer device is capable of being inserted or removed from the image forming apparatus with the first gear disengaged from the second gear. In a second position the developer device is spaced apart from the image forming device by a predetermined distance when the first gear engages the second gear. The developer device is moved between the first position and the second position, so that the first gear engages the second gear when the developer device has been moved from the first position to the second position. The first gear disengages the second gear when the developer device is in the second position.

16 Claims, 6 Drawing Sheets

IMAGE FORMING APPARATUS INCLUDING A DEVELOPER DEVICE ENGAGING AND DISENGAGING MECHANISM

BACKGROUND OF THE INVENTION

1. Field of the Invention

The present invention relates to a developer device engaging and disengaging mechanism for an image forming apparatus.

2. Description of the Related Art

As use of office automation systems has become widespread in recent years, demand for image forming apparatus which can form varied and quality characters and images on ordinary paper with low noise, has increased. To meet this demand, image forming apparatuses utilizing electrophotography which is also used in copying machines and facsimile equipment, has been widely used. An image forming apparatus which has components divided into replaceable functional units such as a photoconductive drum and a developer device, is desired, so that those functional units can easily be removed and inserted when the life of the photoconductive drum expires or when toner needs to be replenished in the toner hopper of the developer device.

The developer device is typically positioned near the photoconductive drum and is coupled thereto through a gear. Accordingly, in order to easily insert and remove the developer device to and from an image forming apparatus, a mechanism which can properly engage and disengage the developer device in the apparatus, is in great demand.

FIG. 1 is a side view of an electrophotographic recording unit which consists mainly of a laser beam scanner 1, photoconductive drum 2*a*, cleaner 3, charger 4, developer station 5*a*, transfer station 6, discharger 7, fuser station 8*a*, paper transport path 9, paper stacker 11, and paper hoppers 10*a* and 10*b* for recording paper of different sizes.

When a print command is issued to the recording unit in a print-ready state with the power turned on and with a heat roller R1 of the fuser station 8*a* heated up to a predetermined temperature, the recording unit starts a print operation. That is, a sheet of recording paper 12 of a command-designated size is fed onto the paper transport path 9 and transported in the direction of arrow A, toward the photoconductive drum 2*a*. By this time, the photoconductive drum 2*a* has been discharged by the discharger 7, cleaned by the cleaner 3 and newly charged by the charger 4.

The laser beam scanner 1 including a laser oscillator, exposes and scans image data-modulated light onto the photoconductive drum 2*a* to form an electrostatic latent image thereon. The electrostatic latent image formed on the photoconductive drum 2*a* is developed by toner 52 which is picked up from a toner container 50 and attached to a developing roll 51*a*. The toner 52 which is composed of ferromagnetic powder, is charged while being mixed and stirred in the toner container 50. Then, the transfer station 6 transfers the toner-developed image to the recording paper 12 fed from the paper hoppers 10*a* or 10*b*. The image transferred is fused by the heat roller R1 and a pressure roller R2 in the fuser station 8*a*. Finally, the recording paper 12 is fed to the stacker 11.

The recording unit has an upper cover 13, which is on the upper side of the paper transport path 9. The upper cover 13 opens backward by swinging about a shaft (see cover supporting shaft 131 in FIG. 4) positioned to the right of the structure illustrated in FIG. 1.

FIG. 2 is a perspective view of developer station 5*a* which includes guide pins 54*a*–54*d* on the lower part of both sides of a housing 53. A handle 55, provided on the upper part of the housing 53, is used to remove the developer station 5*a* for maintenance or when the toner 52 needs to be changed (e.g., after 4000–6000 sheets of recording paper have been printed). The developer station 5*a* also has gap rolls 56*a* and 56*b* on the ends of the developer roll 51*a*.

FIG. 3 is a sectional view of a unit frame 14*a*, showing guide grooves 15*a*–15*d* which are provided perpendicularly in the unit frame 14*a* of the recording unit. The guide grooves 15*a*–15*d* each have at their lowermost end, a hooked portion (e.g., 10 mm-long) which turns at a right angle toward the photoconductive drum 2*a*. The developer station 5*a* is mounted on the unit frame 14*a* by inserting the guide pins 54*a*–54*d* along the guide grooves 15*a*–15*d*.

FIG. 4 is a side view of a developer station engaging and disengaging mechanism of the related art. A leaf spring 16*a* is coupled at one end to a shaft 17. An arm 18*a* is connected at one end to the shaft 17, and at the other end to a spring 19. The spring 19 forces upward the arm 18*a* and a link bar 20*a* whose lower end contacts the arm 18*a*. Thus, when the upper cover 13 is closed with the cover-supporting shaft 131 serving as a rotational axis, a protruding portion 130 provided on the back of the upper cover 13, presses down the link bar 20*a*. The link bar 20*a* rotates the arm 18*a* counterclockwise against the elasticity of the spring 19, and the leaf spring 16*a* swings in the direction of the arrow B, pressing the rear side 5*a*' of the developer station 5*a*. Accordingly, the developer station 5*a* slides in the direction of the arrows shown in FIG. 3 along the hooked portion of the guide grooves 15*a*–15*d* to the far end. Thus, the gap rollers 56*a* and 56*b* (see FIG. 2) provided at both ends of the developer roll 51*a* contact the photoconductive drum 2*a* at both ends so as to position the developer roll 51*a* at a predetermined distance from the photoconductive drum 2*a*.

FIG. 5 is a side view of the developer station 5*a* of the related art in the engaged position. The developer station 5*a* is provided with a developer gear 57*a* which transmits a rotational force from a power transmission mechanism 21 to the developer roll 51*a* and the toner mixer in the toner container 50 (see FIG. 1). The power transmission mechanism 21 consists of a bracket 22*a*, gears 25*a*, G1 and G2, motor gear G3, pulleys P1 and P2, belt B1, motor M, tension roller R and spring SP. The bracket 22*a* is rotatably-coupled to the unit frame 14*a* (FIG. 3) via an axis 23*a*. Coaxially-coupled gear 25*a* and pulley P1 are rotatably-coupled to one end of the bracket 22*a*. A spring 26*a* is provided at the other end of the bracket 22*a* to force the gear 25*a* to engage the developer gear 57*a*. Thus, a driving force is transmitted through the gears 25*a* and 57*a* to the developer station 5*a* as it is engaged properly with the recording unit. Accordingly, when the upper cover 13 (FIG. 4) is opened, the spring 19 causes the arm 18*a* to rotate, and the leaf spring 16*a* swings in the direction of an arrow C so that the guide pins 54*a*–54*d* of the developer station 5*a* are released from the hooked portions of the guide grooves 15*a*–15*d*. As a result, the developer station 5*a* can be removed from the apparatus using the handle 55. However, gears 25*a* and 57*a* tend to remain engaged until the developer station 5a is manually removed from the image forming apparatus.

As described above, in order to smoothly engage or disengage the developer station 5a by sliding it along the hooked portions of the guide grooves 15a–15d, it is necessary that the gear 25a and the developer gear 57a rotate while being engaged with each other, because of a large rotational torque which the gears provide. Accordingly, it is difficult to engage and disengage the developer station smoothly when the developer station is removed from or inserted into an image forming apparatus when maintenance is required.

SUMMARY OF THE INVENTION

It is an object of the present invention to provide a developer device engaging and disengaging mechanism which can smoothly engage and disengage a developer device.

It is another object of the present invention to provide a developer engaging and disengaging mechanism which can economically and reliably engage and disengage a developer device.

To achieve the above and other objects, the present invention moves the developer device between a first position where the developer device is capable of being mounted or dismounted, with the first gear for driving the developer device disengaged from the second gear, and a second position where the developer device faces the image forming device at a predetermined distance, with the first gear engaged with the second gear. In the second position, the second gear which is coupled to a frame of the image forming apparatus, transmits power from a power source to the first gear. In accordance with the present invention, the first gear engages the second gear when the developer device has been moved from the first position to the second position, and the first gear is disengaged from the second gear when the developer device is in the second position.

BRIEF DESCRIPTION OF THE DRAWINGS

Throughout the above-mentioned drawings, identical reference numerals are used to designate the same or similar component parts.

DESCRIPTION OF THE PREFERRED EMBODIMENTS

Figure 6:
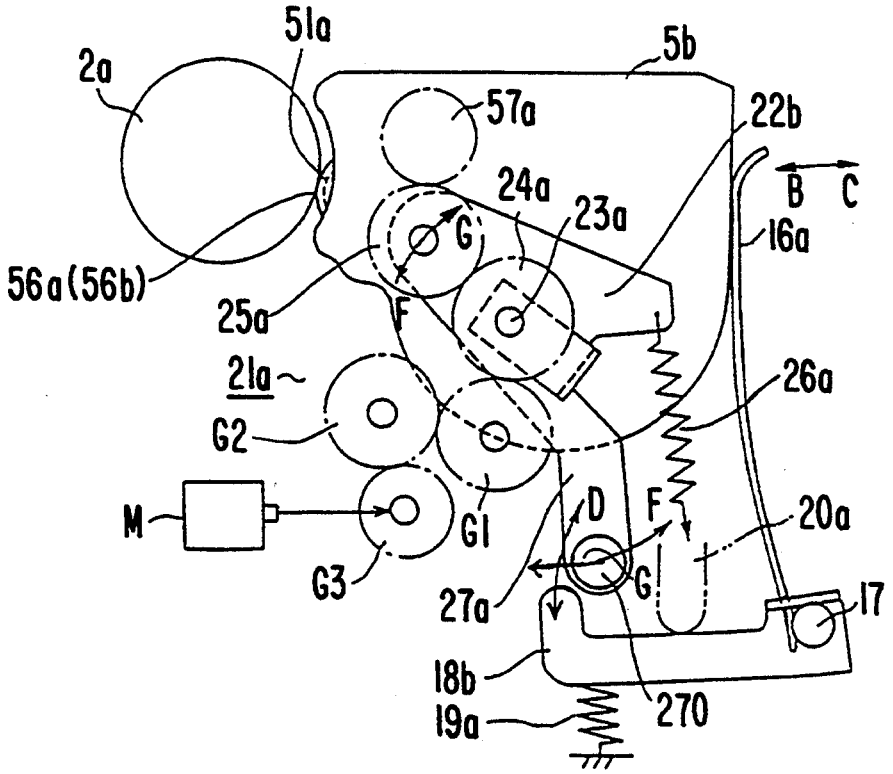
FIG. 6 is a side view of a developer station and its engaging and disengaging mechanism in accordance with an embodiment of the present invention.

FIG. 6 is a side view of a developer station and its engaging and disengaging mechanism in accordance with an embodiment of the present invention, as it is installed in an electrophotographic recording unit in accordance with the related art.

A developer station 5b, including a developer gear 57a and a developer roll 51a, is constructed such that it is capable of being mounted on and dismounted from the unit frame 14a (FIG. 3) which is coupled to axis 23a. The developer roll 51a develops an electrostatic latent image formed on the photoconductive drum 2a. The developer gear 57a transmits rotational power to the developer roll 51a. A leaf spring 16a presses or biases the developer station 5b toward the photoconductive drum 2a to a position where developer roll 51a is spaced by a predetermined distance from the photoconductive drum 2a.

A bracket 22b, which is provided with gears 25a and 24a, spring 26a and link block 27a, is supported on and rotatably-coupled to the unit frame 14a via an axis 23a. The gear 24a is rotatably-coupled to the axis 23a and is engaged with a power transmission mechanism 21a including a motor M, and gears G3, G2 and G1. The gear 25a is rotatably-coupled to the bracket 22b and is engaged with the gear 24a. The spring 26a pulls the bracket 22b to rotate it about the axis 23a and forces the gear 25a toward the developer gear 57a, so that the gears 25a and 57a engage each other.

The link block 27a, which is a protruding lower part of the bracket 22b, is provided with a follower rod 270 at one end. One end of an arm 18b is coupled to a shaft 17 to which the leaf spring 16a is connected, and the other end is positioned under the follower rod 270. The lower end of a link bar 20a contacts the surface of the arm 18b, and a spring 19a presses against the bottom of the arm 18b. Accordingly, when downward pressure from the link bar 20a is removed (e.g., when the cover 13 is opened), the end of the arm 18b contacts and links the follower rod 270. The elastic force of the spring 19a is set such that the value of torque provided by the spring 19a to rotate the bracket 22b via the follower rod 270 in the direction of arrow F, is larger than the torque provided by the spring 26a to rotate the bracket 22b in the direction of arrow G.

Figure 7:
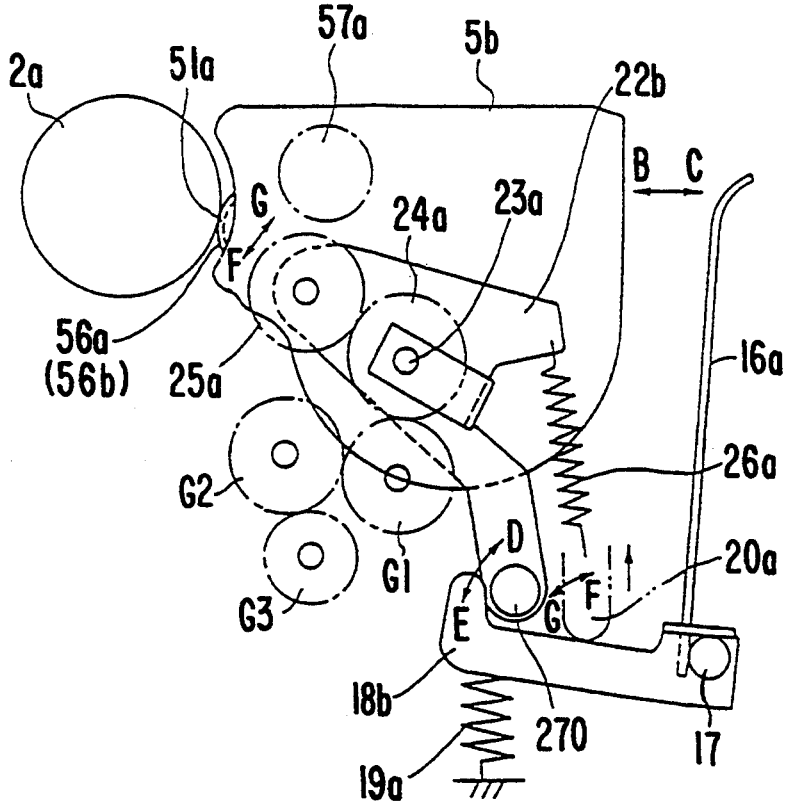
FIG. 7 is a diagram illustrating the operation of the developer station engaging and disengaging mechanism of the present invention.

FIG. 7 is a diagram illustrating the operation of the developer station engaging and disengaging mechanism in accordance with the present invention. When the upper cover 13 is opened and the pressure which the link bar 20a exerts on the arm 18b is removed, the spring 19a rotates the arm 18b in the direction of the arrow D and the shaft 17 rotates accordingly. The leaf spring 16a swings in the direction of the arrow C and, simultaneously, the bracket 22b, which is linked to the follower rod 270, rotates in the direction of the arrow F. Thus, the gear 25a disengages the developer gear 57a. That is, when the upper cover 13 is opened, the leaf spring 16a and gear 25a move from the normal position (i.e., the position of leaf spring 16a and gear 25a when the recording unit is operable), whether or not the developer station 5b is mounted on the unit frame 14a.

Figure 1:
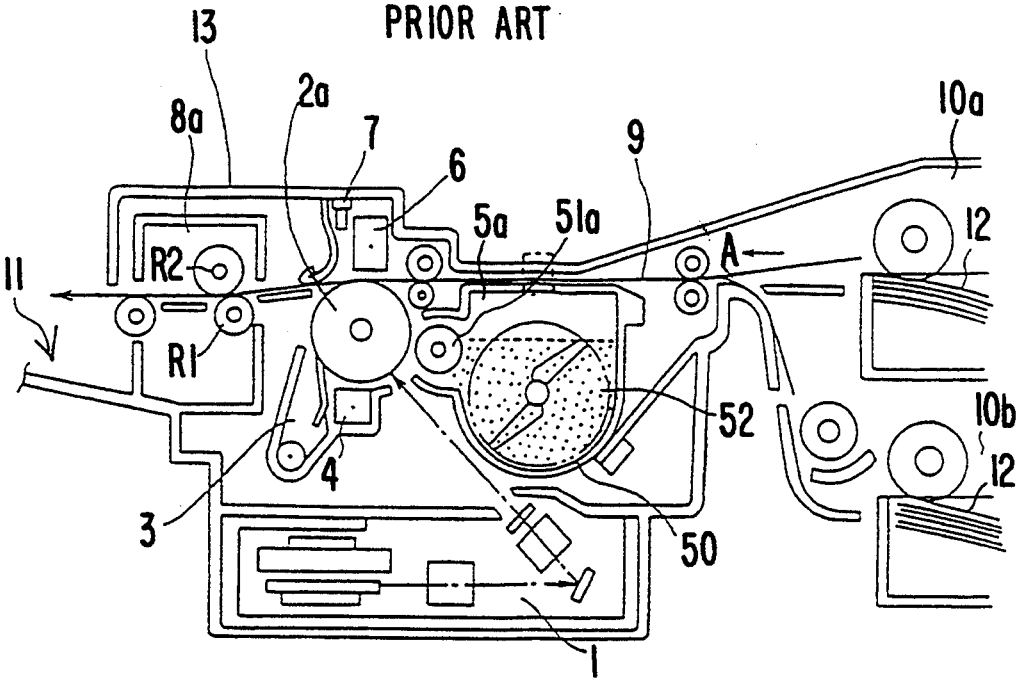
FIG. 1 PRIOR ART
FIG. 1 is a side view of an electrophotographic recording unit.
Figure 2:
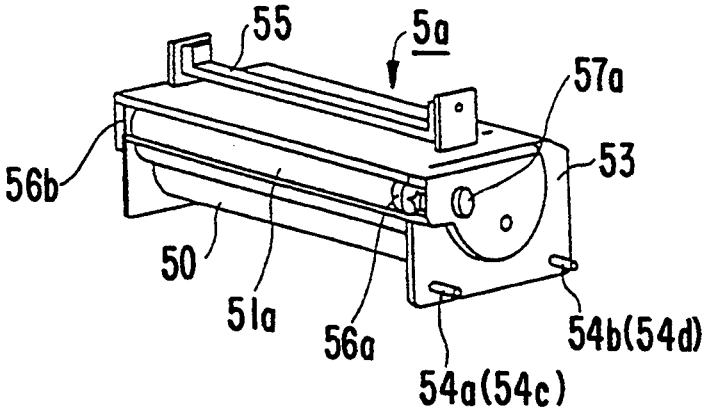
FIG. 2 PRIOR ART
FIG. 2 is a perspective view of a developer station.
Figure 3:
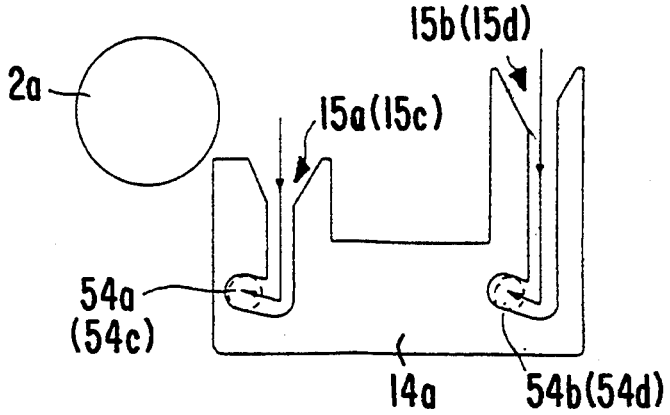
FIG. 3 PRIOR ART
FIG. 3 is a sectional view of a unit frame, showing guide grooves.
Figure 4:
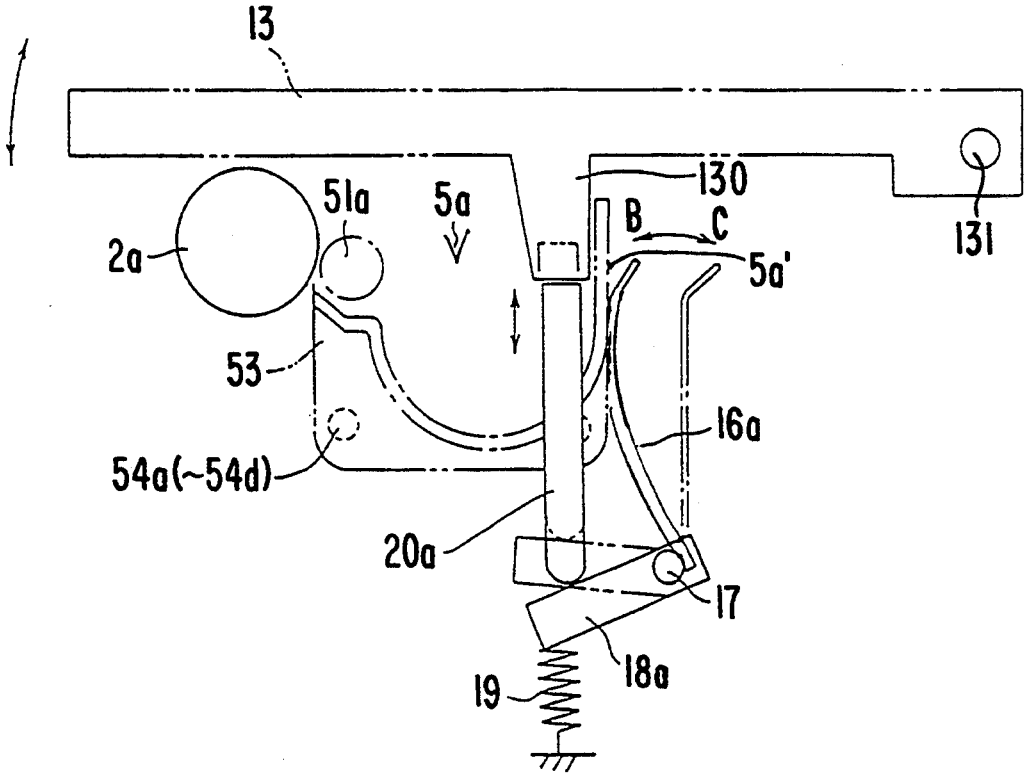
FIG. 4 PRIOR ART
FIG. 4 is a side view of a developer station engaging and disengaging mechanism of the related art.
Figure 5:
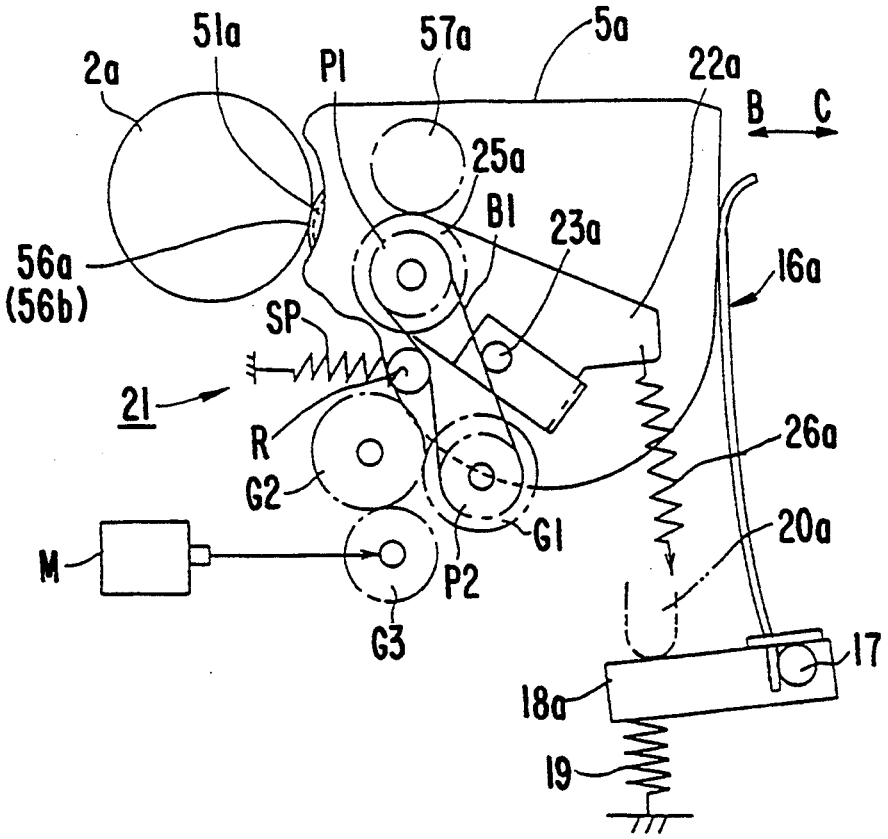
FIG. 5 PRIOR ART
FIG. 5 is a side view of the developer station of the related art in the engaged position.

Therefore, the developer station 5b is engaged in the following order:

(1) Guide pins 54a–54d of the developer station 5b are inserted along the guide grooves 15a–15d of the unit frame 14a, and into the bottoms as illustrated in FIG. 3.

(2) Closing the upper cover 13 causes the link bar 20a to press the arm 18b and rotate arm 18b in the direction of the arrow E.

(3) The leaf spring 16a presses the developer station 5b in the direction of the arrow B and moves it to the position where the developer roll 51a and the photoconductive drum 2a are spaced apart by a predetermined distance.

(4) The arm 18b is released from linkage with the follower rod 270 and the spring 26a pulls and rotates the bracket 22b in the direction of the arrow G, to engage the gear 25a with the developer gear 57a.

In contrast, the developer station 5b is disengaged in reverse order. When the upper cover 13 is opened, the leaf spring 16a swings in the direction of the arrow C and, at the same time, the gear 25a is released from engagement with the developer gear 57a. Accordingly, the developer station 5b slides along the hooked portions of the guide grooves 15a–15d to the corner portions thereof. Then, the developer station 5b can be removed from the unit frame 14a by pulling up on the handle 55. Since the gear 25a of the bracket 22b is disengaged from the developer gear 57a beforehand, the developer station 5b can be inserted into and removed from the recording unit easily and smoothly.

The above embodiment describes an example where the arm 18b is rotated by the pressure from the link bar 20a, which is caused by closing the upper cover 13. However, the arm 18b may be rotated by other means, e.g., manually or by rotating the shaft 17 using a motor.

Figure 8:
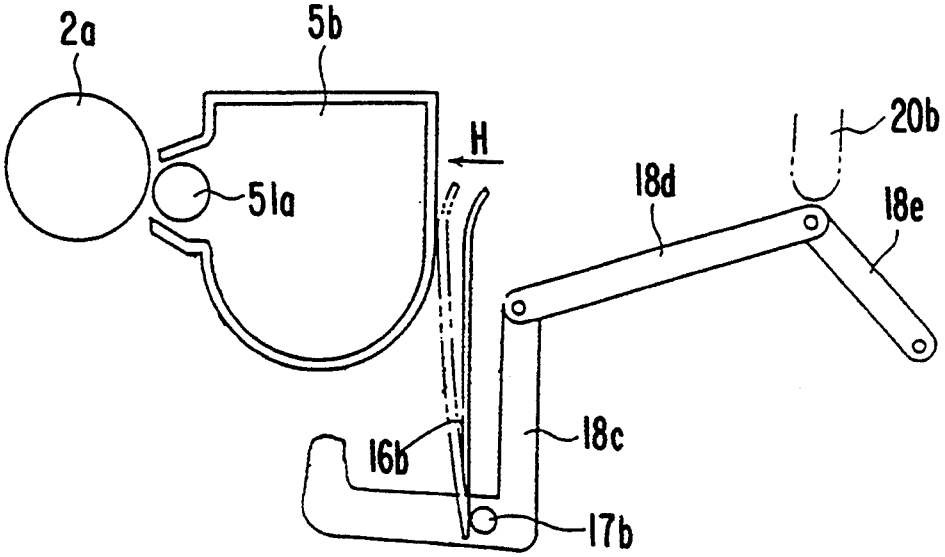
FIG. 8 is a side view of a modification to the embodiment of the present invention.

FIG. 8 is a diagram of a modification to the embodiment of FIG. 6 and particularly to the mechanism including the arm 18b and the link bar 20a in FIG. 6. The arm 18b in FIG. 6 corresponds to an arm 18c in FIG. 8, and the link bar 20a in FIG. 6 corresponds to a set of arms 18d and 18e and link bar 20b in FIG. 8. In FIG. 8, the L-shaped arm 18c is rotatably-coupled to a shaft 17b and one side of the arm 18c is provided almost in parallel to the leaf spring 16a. The ends of the arm 18d are rotatably-coupled to one end of the arm 18c and one end of the arm 18e, respectively. The other end of the arm 18e is also rotatably-coupled to the unit frame 14a so that the arms 18d and 18e become upwardly doglegged. When the upper cover 13 is closed, the link bar 20b presses down on the joint of the arms 18d and 18e and causes the other end of the arm 18d to extend leftward because the arm 18e is fixed at one end. The link 20b also causes the arm 18c and thus the shaft 17b to rotate counterclockwise. The leaf spring 16b swings in the direction shown by an arrow H and presses the developer station 5b toward the photoconductive drum 2a so that the gear 25a engages the developer gear 57a. Thus, the developer station 5b is secured there stably.

With the arms 18c, 18d and 18e so-constructed, the vertical component of a restoring force of the leaf spring 16b which is provided to the arms 18d and 18e is reduced sharply (e.g., to zero when the arms 18d and 18e are straightened). Therefore, the force with which the link bar 20b presses up against the upper cover 13 is minimized.

A stopper may be provided under the joint of the arms 18d and 18e, to prevent the link bar 20b from being pressed further down when the arms 18d and 18e become slightly doglegged downwardly. In this state, the above-mentioned vertical component of the force is downward, which allows the link bar 20b to stay where it is pressed down and to cause no upward pressure against the upper cover 13. To disengage the developer station 5b, it is only necessary to release the above-mentioned state. Thus, the improvement can prevent the upper cover 13 from being deformed and can prevent wear on mechanical parts which are subject to sliding due to opening and closing the upper cover 13.

As is apparent from the above description, since the gear 25a disengages from the developer gear 57a and the developer station 5b moves from the normal operating position automatically just by opening the upper cover 13, for example, the developer station 5b can be inserted into and removed from the recording unit easily and smoothly.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be resorted to as falling within the scope of the invention in the appended claims and their equivalents.

What is claimed is:

1. An image forming apparatus comprising:

an image forming device for forming an image;

a developer device which develops the image formed by said image forming device;

a first gear for driving the developer device;

a frame;

a second gear coupled to said frame;

a power source coupled to said second gear, said developer device being placed in a first position where said first gear is disengaged from said second gear so that the developer device is capable of being inserted into or removed from said image forming apparatus, or a second position where said first gear is engaged with said second gear, so that said developer device is spaced apart from said image forming device by a predetermined distance;

movement means for moving said developer device between the first position and the second position;

engaging means for engaging said first gear with said second gear when said developer device has been moved from the first position to the second position; and disengaging means for disengaging said first gear from said second gear when said developer device is in the second position.

2. An image forming apparatus according to claim 1, wherein said movement means comprises:

a shaft;

a first spring;

an arm which is rotatably-coupled at one end to said shaft and provided at the other end with said first spring;

a bar positioned adjacent said arm to rotate said arm against the elasticity of said first spring when said bar presses against said arm; and an elastic member, coupled to said shaft, for moving said developer device toward said image forming device when said arm is rotated by said bar.

3. An image forming apparatus according to claim 2, further comprising a cover coupled to said bar, wherein said bar is pressed against said arm when said cover is closed.

4. An image forming apparatus according to claim 3, further comprising a bracket having a middle portion which is rotatably-coupled to said frame, wherein said bracket has a first end on a first side and second and third ends on a second side, wherein said second gear is rotatably-coupled to the first end, wherein said engaging means comprises a second spring, provided on the second end of said bracket, for rotating the bracket in the direction where the second gear engages with said first gear, and wherein said disengaging means comprises a link block, provided on the third end, for linking to said arm and rotating said bracket in the direction where the second gear disengages from said first gear when said arm is rotated by the restoring force of said first spring.

5. An image forming apparatus according to claim 1, further comprising a bracket having a middle portion which is rotatably-coupled to said frame, wherein said bracket has a first end on a first side and second and third ends on a second side, wherein said second gear is rotatably-coupled to the first end, wherein said engaging means comprises a second spring, provided on the second end of said bracket, for rotating the bracket in the direction where the second gear engages with said first gear, and wherein said disengaging means comprises a link block, provided on the third end, for linking to said arm and rotating said bracket in the direction where the second gear disengages from said first gear when said arm is rotated by the restoring force of said first spring.

6. An image forming apparatus according to claim 2, further comprising a bracket having a middle portion which is rotatably-coupled to said frame, wherein said bracket has a first end on a first side and second and third ends on a second side, wherein said second gear is rotatably-coupled to the first end, wherein said engaging means comprises a second spring, provided on the second end of said bracket, for rotating the bracket in the direction where the second gear engages with said first gear, and wherein said disengaging means comprises a link block, provided on the third end, for linking to said arm and rotating said bracket in the direction where the second gear disengages from said first gear when said arm is rotated by the restoring force of said first spring.

7. An image forming apparatus comprising:

an image forming device for forming an image;

a developer device which develops the image formed by said image forming device;

a first gear for driving the developer device;

a frame;

a second gear coupled to said frame;

a power source coupled to said second gear, said developer device being placed in a first position where said first gear is disengaged from said second gear so that the developer device is capable of being inserted into or removed from said image forming apparatus, or a second position where said first gear is engaged with said second gear, so that said developer device is spaced apart from said image forming device by a predetermined distance;

movement means for moving said developer device between the first position and the second position;

engaging means for engaging said second gear with said first gear when said developer device has been moved from the first position to the second position; and disengaging means for disengaging said second gear from said first gear when said developer device is in the second position.

8. An image forming apparatus according to claim 7, wherein said movement means comprises:

a shaft;

a first spring;

an arm which is rotatably-coupled at one end to said shaft and provided at the other end with said first spring;

a bar positioned adjacent said arm to rotate said arm against the elasticity of said first spring when said bar presses against said arm; and an elastic member, coupled to said shaft, for moving said developer device toward said image forming device when said arm is rotated by said bar.

9. An image forming apparatus according to claim 8, further comprising a cover coupled to said bar, wherein said bar is pressed against said arm when said cover is closed.

10. An image forming apparatus according to claim 9, further comprising a bracket having a middle portion which is rotatably-coupled to said frame, wherein said bracket has a first end on a first side and second and third ends on a second side, wherein said second gear is rotatably-coupled to the first end, wherein said engaging means comprises a second spring, provided on the second end of said bracket, for rotating the bracket in the direction where the second gear engages with said first gear, and wherein said disengaging means comprises a link block, provided on the third end, for linking to said arm and rotating said bracket in the direction where the second gear disengages from said first gear when said arm is rotated by the restoring force of said first spring.

11. An image forming apparatus according to claim 7, further comprising a bracket having a middle portion which is rotatably-coupled to said frame, wherein said bracket has a first end on a first side and second and third ends on a second side, wherein said second gear is rotatably-coupled to the first end, wherein said engaging means comprises a second spring, provided on the second end of said bracket, for rotating the bracket in the direction where the second gear engages with said first gear, and wherein said disengaging means comprises a link block, provided on the third end, for linking to said arm and rotating said bracket in the direction where the second gear disengages from said first gear when said arm is rotated by the restoring force of said first spring.

12. An image forming apparatus according to claim 8, further comprising a bracket having a middle portion which is rotatably-coupled to said frame, wherein said bracket has a first end on a first side and second and third ends on a second side, wherein said second gear is rotatably-coupled to the first end, wherein said engaging means comprises a second spring, provided on the second end of said bracket, for rotating the bracket in the direction where the second gear engages with said first gear, and wherein said disengaging means comprises a link block, provided on the third end, for linking to said arm and rotating said bracket in the direction where the second gear disengages from said first gear when said arm is rotated by the restoring force of said first spring.

13. An image forming apparatus comprising:

an image forming device for forming an image;

a developer station for developing the image formed by said image forming device, said developer station having a first position at which said developer station is positioned at a predetermined position with respect to said image forming device so as to be capable of performing a developing operation, said developer station having a second position at which said developer station is spaced apart from said image forming device;

a cover which can be opened and closed;

means for moving said developer station to the second position when said cover is closed and for moving said developer station to the first position when said cover is opened;

means for driving said developer station to perform the developing operation when said developer station is in the first position.

14. An image forming apparatus according to claim 13, wherein:

said developer station includes a first gear;

said driving means includes a second gear which engages said first gear when said developer station is in the first position; and said moving means includes means for engaging and disengaging said first and second gears when said developer station is moved between the first and second positions.

15. An image forming apparatus according to claim 14, further comprising an actuating member extending from said cover, wherein said moving means includes:

a bracket coupled to said second gear, said bracket having first and second extending portions;

a first spring;

a second spring coupled to the second extending portion of said bracket; and an arm positioned against said first spring and in contact with said actuating member when said cover is closed, so that when said cover is opened, said first spring pushes said arm against the first extending portion of said bracket to cause said second gear to disengage from said first gear.

16. An image forming apparatus according to claim 15, wherein said moving means further comprises an elastic member, coupled to said arm, for moving said developer station toward said image forming device when said arm is pressed against said first spring by said actuating member.

* * * * *